US008287669B2

(12) United States Patent
Kaneko et al.

(10) Patent No.: US 8,287,669 B2
(45) Date of Patent: Oct. 16, 2012

(54) COPPER ALLOY FOR ELECTRIC AND ELECTRONIC EQUIPMENTS

(75) Inventors: Hiroshi Kaneko, Tokyo (JP); Tatsuhiko Eguchi, Tokyo (JP); Kuniteru Mihara, Tokyo (JP); Kiyoshige Hirose, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 179 days.

(21) Appl. No.: 12/130,203

(22) Filed: May 30, 2008

(65) Prior Publication Data

US 2008/0298998 A1 Dec. 4, 2008

(30) Foreign Application Priority Data

May 31, 2007 (JP) ..... 2007-145964
May 26, 2008 (JP) ..... 2008-136851

(51) Int. Cl.
*C22C 9/06* (2006.01)
*C22C 9/10* (2006.01)

(52) U.S. Cl. ..... 148/433; 148/434; 148/435; 148/436

(58) Field of Classification Search ..... 148/433, 148/434, 435, 436
See application file for complete search history.

(56) References Cited

U.S. PATENT DOCUMENTS

| | | | | |
|---|---|---|---|---|
| 4,594,221 | A | 6/1986 | Caron et al. | |
| 7,182,823 | B2 * | 2/2007 | Mandigo et al. | 148/435 |
| 2002/0029827 | A1 | 3/2002 | Liu et al. | |
| 2002/0108685 | A1 | 8/2002 | Hatakeyama et al. | |
| 2002/0119071 | A1 | 8/2002 | Usami et al. | |
| 2006/0196586 | A1 | 9/2006 | Hasegawa et al. | |
| 2007/0051442 | A1 | 3/2007 | Yamamoto et al. | |

FOREIGN PATENT DOCUMENTS

| | | | |
|---|---|---|---|
| EP | 0 949 343 | A1 | 10/1999 |
| EP | 2000-80428 | A | 3/2000 |
| EP | 1 050 594 | A1 | 11/2000 |
| JP | 09020943 | * | 1/1997 |
| JP | 11-335756 | A | 12/1999 |
| JP | 2005-532477 | A | 10/2005 |
| JP | 3739214 | B2 | 11/2005 |
| JP | 2006-16667 | A | 1/2006 |
| WO | WO 2004/005560 | A2 | 1/2004 |
| WO | WO 2006/093140 | A1 | 9/2006 |
| WO | WO 2006/101172 | A1 | 9/2006 |

OTHER PUBLICATIONS

Concise explanation of documents for documents JP-T-2005-532477 and Japanese Patent No. 3739214.
European Search Report dated Jun. 2, 2009 issued in corresponding European patent Application No. 08010037.3-1215/1997920.
Japanese Office Action dated Jun. 28, 2011, issued in corresponding Japanese Patent Application No. 2008-136851.

* cited by examiner

*Primary Examiner* — Sikyin Ip
(74) *Attorney, Agent, or Firm* — Westerman, Hattori, Daniels & Adrian, LLP

(57) ABSTRACT

A copper alloy for electric and electronic equipments, containing from 0.5 to 4.0 mass % of Ni, from 0.5 to 2.0 mass % of Co, and from 0.3 to 1.5 mass % of Si, with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a {111} plane, I{200} is a diffraction intensity from a {200} plane, I{220} is a diffraction intensity from a {220} plane, and I{311} is a diffraction intensity from a {311} plane, each at the material surface.

10 Claims, 1 Drawing Sheet

COPPER ALLOY FOR ELECTRIC AND ELECTRONIC EQUIPMENTS

FIELD

The present invention relates to a copper alloy that can be used in electric and electronic equipments.

BACKGROUND

Heretofore, generally, in addition to iron-based materials, copper-based materials, such as phosphor bronze, red brass, and brass, which are excellent in electrical conductivity and thermal conductivity, have been used widely as materials for electric and electronic equipments (electrical and electronic machinery and tools). Recently, demands for miniaturization, lightening of the weight, high-functionalization, and associated high-density packaging of parts of electric and electronic equipments have increased, and various characteristics of higher levels are required for the copper-based materials applied thereto.

For example, a copper alloy to be used for a CPU socket and the like is required to have higher electrical conductivity than conventional copper alloys for heat removal, according to the increase of heat emission of CPU. Further, the environment of use of dedicated automobile-mounted connectors has become severe, and higher electrical conductivity is required for the copper alloy for the terminal materials in order to improve heat radiation.

Meanwhile, thinning of the material has been advanced in association with miniaturization of the parts, with a requirement of improvement of the strength of the material. Requirement of fatigue resistance is also enhanced in the application of relays and the like, with improvement of the strength. Since the conditions for bending the material have become severe in association with miniaturization of the parts, it is required for the material to be excellent in bending property while high strength is maintained. Further, better dimensional accuracy of the parts are also required in association with miniaturization of the parts, and the amount of displacement of spring material at a portion for releasing contact pressure has become lessened. Since permanent setting of the material under a long term use becomes an issue as compared to before, the material is required to have high resistance to stress relaxation. The requirement for stress relaxation resistance is further enhanced, for example, in automobiles, since the environmental temperature for use is high.

These required characteristics have reached to a level that cannot be satisfied with commercially available mass-production alloys, such as phosphor bronze, red brass, and brass. These alloys are enhanced in the strength, by forming a solid solution of tin (Sn) and zinc (Zn) in copper (Cu), followed by subjecting the alloy to cold-working, such as rolling and drawing. However, it is known that while a high strength material may be obtained by applying a high cold-working ratio (generally, 50% or more) by this method, bending property of the resultant alloy is conspicuously impaired, in addition to poor electrical conductivity. This method is generally a combination of solid solution hardening and work hardening.

An alternative of the hardening method is a precipitation hardening method by which the material is hardened by forming nanometer-ordered fine precipitates in the material. This method is applied to many alloy systems, since this method enhances the strength while it has an advantage for simultaneously improving electrical conductivity. Among many precipitation-type alloys, a so-called Corson alloy which is hardened, by adding nickel (Ni) and silicon (Si) in Cu, and by allowing Ni—Si compounds to finely precipitate, has a quite high hardening ability, and is used in some commercially available alloys (for example, CDA 70250 that is a registered alloy of CDA (Copper Development Association)).

Generally, the following two important heat-treatment steps are used in the production process of precipitation hardened-type alloys. One is a heat treatment, called as a solution treatment, for allowing Ni and Si to dissolving into a Cu matrix at a high temperature (generally, 700° C. or higher); and the other is a so-called aging precipitation, which is a heat treatment to be conducted at a lower temperature than the temperature for the solution treatment. The latter is applied for allowing Ni and Si dissolved at a high temperature to precipitate as a precipitate. This hardening method takes advantage of a difference of the amounts of Ni and Si atoms that are dissolved in Cu between at a higher temperature and at a lower temperature, and is well known in the art in the method for producing precipitation-type alloys.

Although the amount of use of the Corson-system alloy is increasing, electrical conductivity of the alloy is not sufficient against high required characteristics as described above. Meanwhile, a Cu—Ni—Co—Si-based alloy in which a part of Ni in the Corson-based alloy is substituted with cobalt (Co) is known (for example, JP-T-2005-532477 ("JP-T" means published searched patent publication)). This alloy system includes precipitation hardened-type alloys of compounds, such as Ni—Co—Si, Ni—Si, and Co—Si, and is featured in smaller solid solution limit than the Corson-based alloy. This alloy system is advantageous in realizing high electrical conductivity since the amount of elements in the solid solution is small.

Contrary to the advantage, the solution treatment temperature is required to be higher than the corresponding temperature in the Cu—Ni—Si system, due to a small solid solution limit. Since the amount of the dissolved element(s) becomes small upon the solution treatment when the solution temperature cannot be raised up, the magnitude of precipitation hardening becomes low in the aging precipitation heat treatment, and the strength is required to be compensated by work hardening at a relatively high working ratio. Consequently, there arises such a problem that bending property that is an important characteristic required may be impaired, due to coarsening of crystal grains when the solution heat treatment temperature is high, or due to increase of dislocation density in the material when work hardening at a relatively high working ratio is introduced. Therefore, these treatments are not able to satisfy the required characteristics of the copper material that are enhanced in the fields of electronic equipments and automobiles in recent years.

For controlling bending property in Cu—Ni—Si alloy systems, accumulation of crystal orientation has been prescribed by X-ray diffraction intensity of the surface of the alloy sheet (for example, Japanese Patent No. 3,739,214). However, this invention relates to a method for controlling the crystal grain diameter by adjusting the conditions for solution heat treatment and for reducing the amount of work hardening, and is not suitable for the above-mentioned requirement of solution heat treatment at a high temperature as in Cu—Ni—Co—Si alloys, since the treatment causes deterioration in the strength and bending property.

SUMMARY

The present invention resides in a copper alloy for electric and electronic equipments, which contains from 0.5 to 4.0 mass % of Ni, from 0.5 to 2.0 mass % of Co, and from 0.3 to 1.5 mass % of Si, with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a {111} plane, I{200} is a diffraction intensity from a {200} plane, I{220} is a diffraction intensity from a {220} plane, and I{311} is a diffraction intensity from a {311} plane, each at the material surface.

Further, the present invention resides in a copper alloy for electric and electronic equipments, which contains from 0.5 to 4.0 mass % of Ni, from 0.5 to 2.0 mass % of Co, and from 0.3 to 1.5 mass % of Si, and contains 3 mass % or less in the sum of one or plural elements selected from silver (Ag), boron (B), chromium (Cr), iron (Fe), hafnium (Hf), magnesium (Mg), manganese (Mn), phosphorus (P), tin (Sn), titanium (Ti), zinc (Zn), and zirconium (Zr), with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a {111} plane, I{200} is a diffraction intensity from a {200} plane, I{220} is a diffraction intensity from a {220} plane, and I{311} is a diffraction intensity from a {311} plane, each at the material surface.

Other and further features and advantages of the invention will appear more fully from the following description, appropriately referring to the accompanying drawings.

DETAILED DESCRIPTION

Figures 1A, 1B:
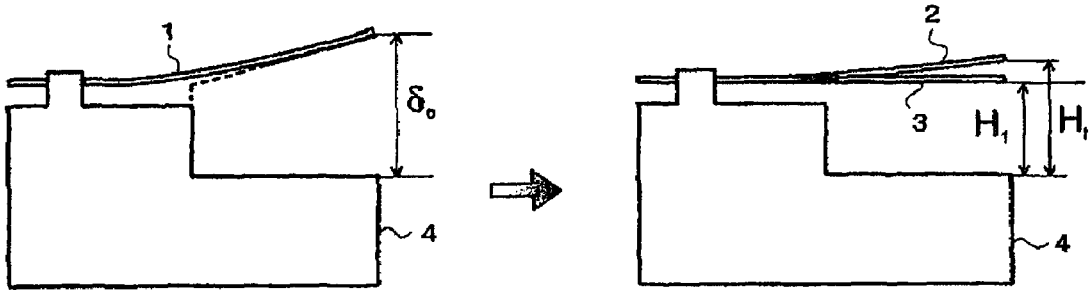
FIGS. 1(*a*) and 1(*b*) are diagrams showing the test method of stress relaxation resistance as conducted in the following examples, in which FIG. 1(*a*) is a diagram showing the state before a heat treatment and FIG. 1 (*b*) is a diagram showing the state after the heat treatment.

The inventors of the present invention, having studied copper alloys suitable for use in electric and electronic parts, have found that the mode of accumulation of crystal orientation prescribed by X-ray diffraction intensity at a material surface (for example, the surface of a sheet or strip shaped material, preferably the sheet surface of the sheet shaped material) has correlation with bending property, in order to largely improve bending property, mechanical strength, electrical conductivity, and stress relaxation resistance, in Cu—Ni—Co—Si-based alloys. The present invention has been completed through intensive studies of the above. In addition, the present invention have been completed, by finding additive elements that serve for improving the mechanical strength and stress relaxation resistance, without impairing electrical conductivity in the alloy system, and by finding an average crystal grain diameter for improving bending property.

According to the present invention, there is provided the following means:

(1) A copper alloy for electric and electronic equipments, containing from 0.5 to 4.0 mass % of Ni, from 0.5 to 2.0 mass % of Co, and from 0.3 to 1.5 mass % of Si, with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a {111} plane, I{200} is a diffraction intensity from a {200} plane, I{220} is a diffraction intensity from a {220} plane, and I{311} is a diffraction intensity from a {311} plane, each at the material surface;

(2) A copper alloy for electric and electronic equipments, containing from 0.5 to 4.0 mass % of Ni, from 0.5 to 2.0 mass % of Co, and from 0.3 to 1.5 mass % of Si, and contains 3 mass % or less in the sum of one or plural elements selected from Ag, B, Cr, Fe, Hf, Mg, Mn, P, Sn, Ti, Zn, and Zr, with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a (111) plane, I{200} is a diffraction intensity from a {200} plane, I{220} is a diffraction intensity from a {220} plane, and I{311} is a diffraction intensity from a {311} plane, each at the material surface;

(3) The copper alloy for electric and electronic equipments according to (1) or (2), which has an average crystal grain diameter of 20 μm or less; and (4) The copper alloy for electric and electronic equipments according to any one of (1) to (3), which has a 0.2% proof stress of 600 MPa or more, and an electrical conductivity of 40% IACS or more.

Preferable embodiments of the copper alloy of the present invention will be described in detail below. In the following description, as an example, the copper alloy of the present invention will be described, which has a shape, for example, of sheet or strip.

Ni, Co, and Si are elements to be added for enhancing the strength of the copper alloy, by precipitation hardening of Ni—Si, Co—Si, and Ni—Co—Si compounds, by controlling the proportion of addition of Ni+Co and Si. The Ni content is in the range from 0.5 to 4.0 mass %, preferably in the range from 1.0 to 3.0 mass %. The Co content is in the range from 0.5 to 2.0 mass %, preferably in the range from 0.7 to 1.7 mass %. The Si content is in the range from 0.3 to 1.5 mass %, preferably in the range from 0.4 to 1.2 mass %. Electrical conductivity decreases when the amounts of addition of these elements are larger than the prescribed ranges, while the strength becomes poor when the amounts of addition of these elements are smaller than the prescribed ranges.

For improving bending property, the inventors of the present invention have investigated the cause of cracks to occur at a bent portion, and we found that the cause is plastic deformation that locally develops and that locally reaches the working limit. As a countermeasure, it is found that bending property may be improved, by enhancing the X-ray diffraction intensity from the {200} plane at the sheet surface. This is because an effect for suppressing local deformation belts and shear belts that are to be the causes of the local cracks from being developed, is manifested when the sheet is subjected to bending while the {200} plane is oriented in the surface direction. In other words, an effect for dispersing deformation may be exhibited, by adopting an azimuth relation that permits sliding system of as much atoms as possible to be active against the stress direction of bending, and the cracks may be suppressed from being occurred by suppressing local deformation from being developed.

The R{200} is 0.3 or more, preferably 0.4 or more, in which the R{200} is the proportion of the diffraction intensity from the {200} plane of the following diffraction intensities and is represented by R{200}=I{200}/(I{111}+I{200}+I{220}+I{311}), I{111} is the diffraction intensity from the {111} plane, I{200} is the diffraction intensity from the {200} plane, I{220} is the diffraction intensity from the {220} plane, and I{311} is the diffraction intensity from the {311} plane, each at the sheet surface. By making the R{200} in the above-mentioned range, it is possible to improve the bending property. While the upper limit of the R{200} is not particularly restricted in the present invention, it is generally 0.98 or less.

In the present invention, the material surface (for example, sheet surface) that defines the R{200} refers to the surface of the sheet or the like of the final state finished through the whole series of manufacturing process.

Examples of the method for increasing or decreasing the R{200} of the copper alloy according to the present invention, include the following manufacturing conditions, but the method is not limited thereto. I{200} increases to increase the R{200}, by introducing intermediate annealing to an extent that the work texture is not completely recrystallized, followed by intermediate rolling, before the final heat treatment for recrystallization. Further, the diffraction intensities of I{111} and I{220} increase, by applying cold-working and the final heat treatment for recrystallization, after repeating cold-working and heat treatment for recrystallization one time or a plurality of times after hot rolling, which resultantly decreases the R{200}. Alternatively, I{311} increases, by applying the final heat treatment for recrystallization after subjecting the sheet to cold-working with a high working ratio of 90% or more after hot-rolling, which resultantly decreases the R{200}.

An example of the process for attaining the characteristic R{200} as defined in the present invention is shown below, but the present invention is not limited to this example. Since the R{200} in the final state after completing the whole process is largely governed by the crystal orientation developed upon recrystallization of the material caused in the final heat treatment for intermediate solution treatment in the manufacturing process, and the step before the final heat treatment for intermediate solution treatment is preferably adjusted properly. Herein, the "final heat treatment for intermediate solution treatment" is the heat treatment for solution treatment which is conducted lastly in order of the steps, among the heat treatments for solution treatment, which are conducted in a plurality of times between one step and another step in the whole process. As a step to be conducted before such a final heat treatment for intermediate solution treatment, it is preferable to apply the final heat treatment for intermediate solution treatment, after cold rolling with a working ratio of 50% or more, followed by heat treatment to give partial recrystallization or to give a recrystallized structure with an average crystal grain diameter of 5 μm or less, and then cold rolling with a working ratio of 50% or less. Examples of the "heat treatment to give partial recrystallization or to give a recrystallized structure with an average crystal grain diameter of 5 μm or less" includes, holding the alloy at a temperature range from 350 to 750° C. for 5 minutes to 10 hours, or holding the alloy at a higher temperature range from 600 to 850° C. for 5 seconds to 5 minutes, but the present invention is not limited thereto. A good recrystallized structure is obtained by such a heat treatment. Next, examples of preferable steps after the final heat treatment for intermediate solution treatment will be described below. For example, after the final heat treatment for intermediate solution treatment, by conducting intermediate cold rolling, heat treatment for aging precipitation, finish cold rolling, and temper annealing, the mechanical strength, electrical conductivity, and other characteristics can be controlled according to the use. It is preferable to set the cold-working ratio (reduction ratio) to 30% or less in the finish cold-rolling after the heat treatment for aging precipitation.

Next, the effects of optional alloying elements, such as Ag, B, Cr, Fe, Hf, Mg, Mn, P, Sn, Ti, Zn, and Zr, to be optionally added to the alloy of the present invention, will be described below. These elements may give a bad influence, such as decrease of electrical conductivity, when the sum total of the contents of those is too large. In order to sufficiently use the addition effects, without decreasing electrical conductivity, the contents in the sum total of those is generally 3 mass % or less, preferably from 0.01 to 2.5 mass %, more preferably from 0.03 to 2 mass %.

Stress relaxation resistance may be improved by adding Mg, Sn, and Zn to the Cu—Ni—Co—Si-based alloy. Adding these elements together further improves stress relaxation resistance by a synergic effect rather than adding any one of those elements singly. Embrittlement by soldering may be also remarkably improved by adding these elements. The total amount of contents of Mg, Sn, and Zn is preferably in the range more than 0.05 mass % but not more than 2 mass %. The effect of addition of these elements may not be exhibited when the total amount is too small, while electrical conductivity may be decreased when the total amount is too large.

Addition of Mn improves hot-workability, as well as enhancing the mechanical strength. This is presumed based on that Mn may further increase the amount of precipitation hardening by aging treatment, since Mn suppresses solute atoms from being segregated at grain boundaries in hot working while the amount of solute atoms in the solid solution is increased.

Cr, Fe, Ti, Zr, and Hf precipitate as a fine compound with Ni, Co, or Si, or as fine element, to contribute to precipitation hardening. Further, those elements have such effects that the compounds are precipitated with a size from 50 to 500 nm, to make the crystal grain diameter fine by suppressing growth of the grains, thereby to improve bending property.

Furthermore, excellent bending property may be obtained, by controlling the average crystal grain diameter generally to be 20 μm or less, preferably 10 μm or less. The lower limit of the average crystal grain diameter is not particularly limited in the present invention, but it is generally 3 μm or more. The crystal grain diameter is measured according to JIS H 0501 (entitled as "Cutting Method").

In the copper alloy of the present invention, excellent bending property and mechanical strength and electrical conductivity can be exhibited at the same time, by controlling the amounts of blending of major components Ni, Co, and Si, and the X-ray diffraction intensity of the {200} plane within the prescribed ranges, and, if necessary optionally, by controlling the amounts of blending of other optional elements and the average crystal grain diameter within the preferable ranges. The tensile strength (0.2% proof stress) of the copper alloy of the present invention according to JIS Z2241 is preferably 600 MPa or more, more preferably 650 MPa or more, and the electrical conductivity is preferably 40% IACS or more, more preferably 45% IACS or more. The upper limit of 0.2% stress proof is not particularly limited, it is generally 1,000 MPa or less. The upper limit of electrical conductivity is not particularly limited, it is generally 70% IACS or less. The stress relaxation ratio measured under the condition of 150° C.×1,000 hours according to The Standard of Electronic Materials Manufacturers Association of Japan EMAS-3003, which is the formerly-used name of the standard, is preferably 40% or less, more preferably 25% or less. The lower limit of the stress relaxation ratio is not particularly limited, it is generally 3% or more.

The copper alloy of the present invention for the electric and electronic equipments is excellent in the mechanical strength, bending property, electrical conductivity, and stress relaxation-resistance. By exhibiting the above-described characteristics, the copper alloy of the present invention can be favorably used for lead frames, connectors, and, terminal materials for electric and electronic equipments, particularly for connectors, terminal materials, relays, and switches for automobile-mounted parts, and the like.

The present invention will be described in more detail based on the following examples, but the invention is not intended to be limited thereto.

EXAMPLES

Example 1

A respective alloy having a composition prepared by blending the elements, as shown in the following tables, with the balance of Cu and inevitable impurities, was melt in a high frequency melting furnace, and an ingot thereof was obtained by casting followed by cooling at a cooling rate of 0.1 to 100° C./sec. The cast alloy was held at a temperature of 900 to 1,020° C. for 3 minutes to 10 hours, followed by hot working and then water quenching. The surface of the resultant alloy was subjected to scalping for removing the oxide scale.

As the subsequent steps, a combination of the treatments in the following steps A-1 to B-4 was conducted, to produce the respective copper alloy.

The production process includes one or two times or much number of solution heat treatments. The steps are classified into two groups before and after the final solution heat treatment. The step before the intermediate solution treatment is designated to as 'Step A' including steps A-1 to A-6, and the step after the intermediate solution treatment is designated to as 'Step B' including steps B-1 to B-4. By a combination selected from those steps, copper alloys of the examples according to the present invention and those of comparative examples were obtained, to give test specimens.

The contents of steps A-1 to A-6 and B-1 to B-4 are shown below.

Step A-1: The alloy was subjected to cold-working with a percent reduction of cross section of 20% or more, followed by solution heat treatment at a temperature of 800° C. to 1,0000° C. for 5 seconds to 30 minutes.

Step A-2: The alloy was subjected to heat treatment at a temperature of 350° C. to 750° C. for 5 minutes to 10 hours, followed by cold-working at a percent reduction of cross section of 20% or more, and then solution heat treatment at a temperature of 800° C. to 1,000° C. for 5 seconds to 30 minutes.

Step A-3: The alloy was subjected to cold-working at a percent reduction of cross section of 20% or more, followed by heat treatment at a temperature of 350° C. to 750° C. for 5 minutes to 10 hours, cold-working at a percent reduction of cross section from 5 to 50%, and solution heat treatment at a temperature of 800° C. to 1,000° C. for 5 seconds to 30 minutes.

Step A4: The alloy was subjected to cold-working at a percent reduction of cross section of 20% or more, followed by solution heat treatment at a temperature of 800° C. to 1,000° C. for 5 seconds to 30 minutes, heat treatment at a temperature of 350° C. to 750° C. for 5 minutes to 10 hours, cold-working at a percent reduction of cross section from 5 to 50%, and solution heat treatment at a temperature of 800° C. to 1,000° C. for 5 seconds to 30 minutes.

Step A-5: The alloy was subjected to cold-working at a percent reduction of cross section of 5% or more, followed by solution heat treatment at a temperature of more than 850° C. but not more than 1,000° C. for 5 seconds to 5 minutes, cold-working at a percent reduction of cross section of 5% or more, and solution heat treatment at a temperature of more than 800° C. to 1,000° C. for 5 seconds to 5 minutes.

Step A-6: The alloy was subjected to cold-working at a percent reduction of cross section of 5% or more, followed by heat treatment at a temperature of 600° C. to 850° C. for 5 seconds to 5 minutes, cold-working at a percent reduction of cross section of 5% or more, and solution heat treatment at a temperature of 800° C. to 1,000° C. for 5 seconds to 5 minutes.

In the solution heat treatments, the heating rate to a holding temperature was 5 to 500° C./sec, and the cooling rate after holding was 1 to 300° C./sec.

Step B-1: The alloy was subjected to heat treatment at a temperature of 400° C. to 700° C. for 5 minutes to 10 hours.

Step B-2: The alloy was subjected to heat treatment at a temperature of 400° C. to 700° C. for 5 minutes to 10 hours, followed by cold-working with a percent reduction of cross section of 30% or less, and temper annealing at a temperature of 200° C. to 550° C. for 5 seconds to 10 hours.

Step B-3: The alloy was subjected to cold-working with a percent reduction of cross section of 50% or less, followed by heat treatment at a temperature of 400° C. to 700° C. for 5 minutes to 10 hours, cold-working with a percent reduction of cross section of 30% or less, and temper annealing at a temperature of 200° C. to 550° C. for 5 seconds to 10 hours.

Step B4: The alloy was subjected to heat treatment at a temperature of 400° C. to 700° C. for 5 minutes to 10 hours, followed by cold-working at a percent reduction of cross section of 50% or less, heat treatment at a temperature of 400° C. to 700° C. for 5 minutes to 10 hours, cold-working at a percent reduction of cross section of 30% or less, and temper annealing at a temperature of 200° C. to 550° C. for 5 seconds to 10 hours.

The following characteristics were investigated for each test specimen. The results are summarized in the tables below.

a. X-ray Diffraction Intensity

Diffraction intensities around one rotation axis were measured for each sample by a reflection method. As the target, copper was used, and X-ray of Kα line was used. The diffraction intensity profile was measured under the condition of tube current 20 mA and tube voltage 40 kV. After removing the background of the diffraction intensity, an integrated diffraction intensity of each peak was determined as a sum of Kα1 and Kα2 peaks, and "R{200}" was calculated from the above-mentioned equation.

b. Bending Property

The portions with bend axis perpendicular and parallel to the rolling direction (W-bending) were defined as 'GW (good way)' and 'BW (bad way)', respectively. Cracks, if any occurred, at the bent portion were observed under an optical microscope at a magnification of 50 times, to observe whether cracks were occurred or not. The inner radius of the bent portion was 0.2 mm. The sample in which no cracks were observed in the fields of view (n=5) was marked by "o" (good), and the sample in which cracks were observed was marked by "x" (poor).

c. Tensile Strength (Abbreviated as "YS" in the Tables Below)

Tensile strengths of 3 test pieces prepared according to JIS Z 2201-13B cut out from the sample in a direction parallel to the rolling direction, were measured according to JIS Z 2241, and an average value thereof (the 0.2% proof stress) is shown.

d. Electrical Conductivity (Abbreviated as "EC" in the Table Below)

Electrical conductivity was calculated by measuring a specific resistance of the sample through a four terminal method in a thermostatic bath maintained at 20° C. (±0.5° C.). The distance between the terminals was set to 100 mm.

e. Stress Relaxation Ratio (Abbreviated as "SR" in the Tables Below)

The stress relaxation ratio was measured under the condition of 150° C.×1,000 hours according to the Standard of Electronic Materials Manufacturers Association of Japan EMAS-3003, which is the formerly-used name of the standard. An initial stress of 80% of the proof stress was applied to the test specimen by a cantilever method.

FIGS. 1(*a*) and 1(*b*) are diagrams illustrating the test method of stress relaxation resistance, in which FIGS. 1(*a*) and 1(*b*) are diagrams showing the states before and after the heat treatment, respectively. As shown in FIG. 1(*a*), an initial stress of 80% of the proof stress was applied to a test piece 1 cantilevered on a test table 4. The position of the test piece 1 is defined to be a distance $\delta_0$ from the standard position. This sample piece has kept in a thermostat bath at 150° C. for 1,000 hours (the heat treatment in a state of the above-mentioned test piece 1). The position of the test piece 2 after removing the load is defined to be a distance $H_t$ from the standard position, as shown in FIG. 1 (*b*). The reference numeral 3 denotes the test piece to which no stress was applied, and the position of the test piece 3 is defined to be a distance $H_t$ from the standard position. The stress relaxation ratio (%) is calculated by $[(H_t-H_1)/\delta_0]\times 100$. In the formula, $\delta_0$ represents a distance from the standard position to the test piece 1, $H_1$ represents a distance from the standard position to the test piece 3, and $H_t$ represents a distance from the standard position to the test piece 2.

f. Average Crystal Grain Diameter (Abbreviated as "GS" in the Tables Below)

The average crystal grain diameter was measured according to JIS H 0501 (cutting method).

TABLE 1-1

| | Alloy component | | | | | | Bending property | | | | | |
|---|---|---|---|---|---|---|---|---|---|---|---|---|
| | Ni | Co | Si | Step | | | Occurrence of cracks | | YS | EC | SR | GS |
| Sample No. | mass % | mass % | mass % | Step A | Step B | R[200] | GW | BW | MPa | % IACS | % | μm |
| Example 1-1 | 0.50 | 1.00 | 0.36 | A-3 | B-3 | 0.45 | ○ | ○ | 652 | 54.2 | 25.1 | 9.5 |
| Example 1-2 | 1.00 | 0.50 | 0.38 | A-4 | B-2 | 0.44 | ○ | ○ | 710 | 51.3 | 24.5 | 8.9 |
| Example 1-3 | 0.70 | 0.80 | 0.45 | A-6 | B-4 | 0.50 | ○ | ○ | 682 | 53.1 | 24.6 | 7.8 |
| Example 1-4 | 0.50 | 1.50 | 0.35 | A-3 | B-4 | 0.48 | ○ | ○ | 715 | 52.0 | 25.2 | 8.2 |
| Example 1-5 | 0.80 | 1.20 | 0.42 | A-4 | B-3 | 0.38 | ○ | ○ | 708 | 51.0 | 23.4 | 8.6 |
| Example 1-6 | 1.00 | 1.00 | 0.48 | A-6 | B-2 | 0.43 | ○ | ○ | 729 | 49.9 | 24.6 | 9.3 |
| Example 1-7 | 1.50 | 0.50 | 0.62 | A-4 | B-2 | 0.60 | ○ | ○ | 704 | 47.1 | 26.2 | 11.5 |
| Example 1-8 | 0.90 | 1.70 | 0.61 | A-3 | B-3 | 0.49 | ○ | ○ | 830 | 46.5 | 25.0 | 12.0 |
| Example 1-9 | 1.10 | 1.50 | 0.55 | A-3 | B-4 | 0.72 | ○ | ○ | 825 | 45.8 | 25.4 | 9.7 |
| Example 1-10 | 1.30 | 1.30 | 0.51 | A-6 | B-2 | 0.57 | ○ | ○ | 790 | 44.7 | 25.0 | 8.5 |
| Example 1-11 | 1.35 | 1.15 | 0.61 | A-6 | B-3 | 0.78 | ○ | ○ | 730 | 53.0 | 25.3 | 12.3 |
| Example 1-12 | 1.35 | 1.15 | 0.61 | A-6 | B-3 | 0.73 | ○ | ○ | 862 | 43.0 | 25.3 | 11.0 |
| Example 1-13 | 1.5 | 1.1 | 0.59 | A-4 | B-4 | 0.73 | ○ | ○ | 780 | 44.0 | 24.0 | 13.2 |
| Example 1-14 | 1.70 | 0.90 | 0.55 | A-4 | B-3 | 0.46 | ○ | ○ | 757 | 43.4 | 24.3 | 9.6 |
| Example 1-15 | 2.50 | 0.50 | 0.71 | A-6 | B-4 | 0.66 | ○ | ○ | 823 | 43.0 | 23.0 | 10.5 |
| Example 1-16 | 2.00 | 1.00 | 0.75 | A-3 | B-2 | 0.59 | ○ | ○ | 815 | 42.9 | 22.6 | 12.3 |
| Example 1-17 | 1.50 | 1.50 | 0.82 | A-4 | B-2 | 0.81 | ○ | ○ | 850 | 42.7 | 22.0 | 11.3 |
| Example 1-18 | 2.60 | 1.50 | 1.02 | A-6 | B-1 | 0.39 | ○ | ○ | 635 | 42.9 | 22.2 | 14.6 |
| Example 1-19 | 3.20 | 1.80 | 1.2 | A-3 | B-2 | 0.61 | ○ | ○ | 849 | 41.0 | 20.0 | 12.1 |

TABLE 1-2

| | Alloy component | | | | | | Bending property | | | | | |
|---|---|---|---|---|---|---|---|---|---|---|---|---|
| | Ni | Co | Si | Step | | | Occurrence of cracks | | YS | EC | SR | GS |
| Sample No. | mass % | mass % | mass % | Step A | Step B | R[200] | GW | BW | MPa | % IACS | % | μm |
| Comparative example 1-1 | 3.2 | 0 | 0.65 | A-3 | B-2 | 0.45 | ○ | ○ | 682 | 34.2 | 22 | 12.5 |
| Comparative example 1-2 | 0.30 | 0.70 | 0.3 | A-4 | B-3 | 0.52 | ○ | ○ | 495 | 55.3 | 26.0 | 13.3 |
| Comparative example 1-3 | 1.50 | 1.00 | 0.25 | A-6 | B-4 | 0.38 | ○ | ○ | 546 | 35.2 | 28.0 | 14.2 |
| Comparative example 1-4 | 4.50 | 1.00 | 1 | A-6 | B-2 | 0.42 | ○ | ○ | 700 | 33.1 | 24.0 | 11.3 |
| Comparative example 1-5 | 1.50 | 2.50 | 0.9 | A-4 | B-3 | 0.50 | x | x | 640 | 41.0 | 23.0 | 14.6 |
| Comparative example 1-6 | 1.50 | 1.20 | 1.6 | A-3 | B-4 | 0.49 | ○ | ○ | 532 | 31.9 | 29.0 | 13.2 |
| Comparative example 1-7 | 1.31 | 1.10 | 0.62 | A-2 | B-2 | 0.05 | x | x | 836 | 43.2 | 25.3 | 9.6 |
| Comparative example 1-8 | 1.53 | 1.13 | 0.59 | A-5 | B-3 | 0.14 | x | x | 829 | 45.1 | 25.3 | 10.5 |
| Comparative example 1-9 | 1.42 | 1.09 | 0.62 | A-1 | B-4 | 0.21 | x | x | 858 | 44.5 | 24.0 | 12.3 |

As shown in Table 1-1, the alloys in Examples 1-1 to 1-19 according to the present invention were excellent each in the bending property, proof stress, electrical conductivity, and stress relaxation resistance. Contrary to the above, as shown in Table 1-2, when the alloys did not satisfy the definition in the present invention, the resultant alloys each were poor in at least one of the above-mentioned characteristics. That is, the alloy in Comparative Example 1-1 was poor in the electrical conductivity, since it did not contain Co. The alloy in Comparative Example 1-2 was low in the amount of precipitation, and the mechanical strength was poor, due to a too low content of Ni. The alloy in Comparative Example 1-3 was low in the amount of precipitation, and the mechanical strength and electrical conductivity were poor, due to a too low content of Si. The alloy in Comparative Example 1-4 was poor in the electrical conductivity, due to a too large content of Ni. The alloy in Comparative Example 1-5 was high in the amounts of crystallization and coarse precipitates, and the bending property was poor, since crystals and precipitates served as the origins of cracks, due to a too large content of Co. The alloy in Comparative Example 1-6 was poor in the electrical conductivity, due to a too large content of Si. The alloys in Comparative Examples 1-7, 1-8, and 1-9 were so low in the R{200} that the bending property was poor.

TABLE 2-1

| | Alloy component | | | | Step | | | Bending property | | | EC | | |
|---|---|---|---|---|---|---|---|---|---|---|---|---|---|
| | Ni | Co | Si | | Step | Step | | Occurrence of cracks | | YS | % | SR | GS |
| | mass | mass | mass | Other elements | | | | | | | | | |
| Sample No. | % | % | % | mass % | A | B | R[200] | GW | BW | MPa | IACS | % | μm |
| Example 2-1 | 0.50 | 1.00 | 0.36 | 0.15Sn, 0.2Ag | A-3 | B-3 | 0.47 | ○ | ○ | 658 | 53.5 | 22.1 | 9.5 |
| Example 2-2 | 1.00 | 0.50 | 0.38 | 0.03Zr, 0.05Mn | A-4 | B-2 | 0.46 | ○ | ○ | 715 | 50.8 | 21.3 | 9.2 |
| Example 2-3 | 0.70 | 0.80 | 0.45 | 0.32Ti, 0.21Fe | A-6 | B-4 | 0.53 | ○ | ○ | 688 | 52.4 | 21.4 | 8.5 |
| Example 2-4 | 0.50 | 1.50 | 0.35 | 0.2Ag, 0.05B, 0.1Mg | A-3 | B-4 | 0.51 | ○ | ○ | 720 | 51.0 | 18.5 | 7.8 |
| Example 2-5 | 0.80 | 1.20 | 0.42 | 0.14Mg, 0.15Sn, 0.3Zn | A-4 | B-3 | 0.39 | ○ | ○ | 706 | 50.2 | 19.2 | 10.2 |
| Example 2-6 | 1.00 | 1.00 | 0.48 | 0.23Cr, 0.14Mg, 0.10P | A-6 | B-2 | 0.44 | ○ | ○ | 735 | 48.1 | 18.0 | 9.8 |
| Example 2-7 | 1.50 | 0.50 | 0.62 | 0.2Hf, 0.2Zn | A-4 | B-2 | 0.72 | ○ | ○ | 720 | 46.0 | 22.5 | 13.2 |
| Example 2-8 | 0.90 | 1.70 | 0.61 | 0.04Zr, 0.42Ti, 0.11Mg | A-3 | B-3 | 0.58 | ○ | ○ | 850 | 45.1 | 18.4 | 11.4 |
| Example 2-9 | 1.10 | 1.50 | 0.55 | 0.15Sn, 0.2Ag | A-3 | B-4 | 0.73 | ○ | ○ | 832 | 44.2 | 21.7 | 12.0 |
| Example 2-10 | 1.30 | 1.30 | 0.51 | 0.11Mg, 0.32Zn | A-6 | B-2 | 0.62 | ○ | ○ | 791 | 44.0 | 18.6 | 9.5 |
| Example 2-11 | 1.35 | 1.15 | 0.61 | 0.14Mg, 0.15Sn, 0.3Zn | A-6 | B-3 | 0.66 | ○ | ○ | 730 | 52.0 | 18.7 | 11.8 |
| Example 2-12 | 1.35 | 1.15 | 0.61 | 0.22Cr, 0.05Mn | A-6 | B-3 | 0.68 | ○ | ○ | 867 | 42.5 | 22.1 | 11.0 |
| Example 2-13 | 1.5 | 1.1 | 0.59 | 0.11Mg, 0.32Zn, 0.5Ti | A-4 | B-4 | 0.53 | ○ | ○ | 785 | 44.1 | 17.2 | 13.2 |
| Example 2-14 | 1.70 | 0.90 | 0.55 | 0.14Mg, 0.15Sn, 0.3Zn | A-4 | B-3 | 0.46 | ○ | ○ | 763 | 42.0 | 16.5 | 12.4 |
| Example 2-15 | 2.50 | 0.50 | 0.71 | 0.23Cr, 0.11Mg, 0.32Zn | A-6 | B-4 | 0.67 | ○ | ○ | 833 | 41.8 | 18.7 | 11.8 |
| Example 2-16 | 2.00 | 1.00 | 0.75 | 0.20Cr, 0.2Sn, 0.2Ag | A-3 | B-2 | 0.65 | ○ | ○ | 828 | 41.5 | 19.8 | 12.3 |
| Example 2-17 | 1.50 | 1.50 | 0.82 | 0.04Mn, 0.2Fe. 0.1Hf | A-4 | B-2 | 0.73 | ○ | ○ | 861 | 41.3 | 21.2 | 13.0 |

TABLE 2-2

| | Alloy component | | | | Step | | | Bending property | | | EC | | |
|---|---|---|---|---|---|---|---|---|---|---|---|---|---|
| | Ni | Co | Si | | Step | Step | | Occurrence of cracks | | YS | % | SR | GS |
| | mass | mass | mass | Other elements | | | | | | | | | |
| Sample No. | % | % | % | mass % | A | B | R[200] | GW | BW | MPa | IACS | % | μm |
| Comparative example 2-1 | 1.10 | 1.50 | 0.55 | 0.5Sn, 1.0Zn, 1.7Mn | A-3 | B-4 | 0.73 | ○ | ○ | 832 | 28.2 | 21.7 | 12.0 |
| Comparative example 2-2 | 1.30 | 1.30 | 0.51 | 1.2Ti, 1.2Fe, 1.0Zn | A-6 | B-2 | 0.62 | ○ | ○ | 791 | 26.2 | 18.6 | 9.5 |
| Comparative example 2-3 | 1.35 | 1.15 | 0.61 | 0.14Mg, 0.15Sn, 0.3Zn | A-1 | B-3 | 0.17 | x | x | 730 | 51.0 | 18.7 | 11.8 |
| Comparative example 2-4 | 1.35 | 1.15 | 0.61 | 0.14Mg, 0.15Sn, 0.3Zn | A-2 | B-3 | 0.08 | x | x | 730 | 49.2 | 18.7 | 11.8 |
| Comparative example 2-5 | 1.35 | 1.15 | 0.61 | 0.22Cr, 0.05Mn | A-5 | B-3 | 0.15 | x | x | 867 | 42.1 | 22.1 | 11.0 |

As shown in Table 2-1, the alloys in Examples 2-1 to 2-17 according to the present invention were excellent each in the bending property, proof stress, electrical conductivity, and stress relaxation resistance. Contrary to the above, as shown in Table 2-2, when the alloys did not satisfy the definition in the present invention, the resultant alloys were poor in at least one of the above-mentioned characteristics. That is, the alloys in Comparative Example 2-1 and 2-2 were poor in the electrical conductivity, due to the too large contents of other additive elements. The alloys in Comparative Examples 2-3, 24, and 2-5 were so low in the R{200} that the bending property was poor.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119(a) on Patent Application No. 2007-145964 filed in Japan on May 31, 2007, and Patent Application No. 2008-136851 filed in Japan on May 26, 2008, each of which is entirely herein incorporated by reference.

What is claimed is:

1. A copper alloy for electric and electronic instruments, containing from 0.5 to 4.0 mass % of Ni, from 0.5 to 2.0 mass % of Co, and from 0.3 to 1.5 mass % of Si, with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a {111} plane, I{200} is a diffraction intensity from a {200} plane, I{220} is a diffraction intensity from a {220} plane, and I{311} is a diffraction intensity from a {311} plane, each at the material surface;

wherein the copper alloy has an average crystal grain diameter of 20 μm or less.

2. The copper alloy for electric and electronic instruments according to claim 1, which has a 0.2% proof stress of 600 MPa or more, and an electrical conductivity of 40% IACS or more.

3. The copper alloy of claim 1, wherein R{200} is 0.98 or less.

4. The copper alloy of claim 1, wherein a sample of the alloy suffers no cracks to a portion subjected to W-bending, in which an inner radius of the bent portion is 0.2 mm, to observe any occurrence of cracks at the thus bent portion under an optical microscope at a magnification of 50 times.

5. The copper alloy of claim 1, wherein the alloy has a stress relaxation ratio of 40% or less, measured under the condition of 150° C. for 1,000 hours.

6. A copper alloy for electric and electronic instruments, containing from 0.5 to 4.0 mass % of Ni, from 0.5 to 2.0 mass % of Co, and from 0.3 to 1.5 mass % of Si, and contains 3 mass % or less in the sum of one or plural elements selected from Ag, B, Cr, Fe, Hf, Mg, Mn, P, Sn, Ti, Zn, and Zr, with the balance of copper and inevitable impurities, wherein R{200} is 0.3 or more, in which the R{200} is a proportion of a diffraction intensity from a {200} plane of the following diffraction intensities and is represented by R{200}=I{200}/(I{111}+I{200}+I{220}+I{311}), I{111} is a diffraction intensity from a {111} plane, I{200} is a diffraction intensity from a {200} plane, I{220} is a diffraction intensity from a {220} plane, and I{311} is a diffraction intensity from a {311} plane, each at the material surface;

wherein the copper alloy has an average crystal grain diameter of 20 μm or less.

7. The copper alloy for electric and electronic instruments according to claim 6, which has a 0.2% proof stress of 600 MPa or more, and an electrical conductivity of 40% IACS or more.

8. The copper alloy of claim 5, wherein R{200} is 0.98 or less.

9. The copper alloy of claim 6, wherein a sample of the alloy suffers no cracks to a portion subjected to W-bending, in which an inner radius of the bent portion is 0.2 mm, to observe any occurrence of cracks at the thus bent portion under an optical microscope at a magnification of 50 times.

10. The copper alloy of claim 6, wherein the alloy has a stress relaxation ratio of 40% or less, measured under the condition of 150° C. for 1,000 hours.

* * * * *